US005649268A

United States Patent [19]

Maebashi et al.

[11] Patent Number: 5,649,268

[45] Date of Patent: Jul. 15, 1997

[54] CHARGING DEVICE HAVING A VOLTAGE WITH A SUPERIMPOSING COMPONENT MODE HAVING A DC COMPONENT AND AN OSCILLATION COMPONENT AND A DC COMPONENT MODE

[75] Inventors: Youichirou Maebashi, Kawasaki; Hiroshi Sasame, Yokohama, both of Japan

[73] Assignee: Canon Kabushiki Kaisha, Tokyo, Japan

[21] Appl. No.: 543,872

[22] Filed: Oct. 19, 1995

[30] Foreign Application Priority Data

| | | | |
|---|---|---|---|
| Oct. 19, 1994 | [JP] | Japan | 6-280040 |
| May 31, 1995 | [JP] | Japan | 7-134181 |
| Oct. 13, 1995 | [JP] | Japan | 7-265463 |

[51] Int. Cl.[6] ..... G03G 15/02

[52] U.S. Cl. ..... 399/168; 361/225

[58] Field of Search ..... 355/219, 208; 361/225

[56] References Cited

FOREIGN PATENT DOCUMENTS 63-149669 6/1988 Japan .

63-149668 6/1988 Japan .

63-208876 8/1988 Japan .

*Primary Examiner*—Arthur T. Grimley

*Assistant Examiner*—Quana Grainger

*Attorney, Agent, or Firm*—Fitzpatrick, Cella, Harper & Scinto

[57] ABSTRACT

A charging device includes a member to be charged; a charging member for charging the member to be charged, the charging member being contactable to the member to be charged and being supplied with a voltage; and wherein upon switching of the voltage from a DC component mode to a superimposing component mode of a DC component and an oscillation component, the DC component is decreased, and a peak-to-peak voltage of the oscillation component is increased in a period, and wherein the peak-to-peak voltage is changed from a first voltage which is smaller than twice a charge starting voltage of the member to be charged to a second voltage which is twice the charge starting voltage, while the peak-to-peak voltage is increasing.

13 Claims, 6 Drawing Sheets

CHARGING DEVICE HAVING A VOLTAGE WITH A SUPERIMPOSING COMPONENT MODE HAVING A DC COMPONENT AND AN OSCILLATION COMPONENT AND A DC COMPONENT MODE

FIELD OF THE INVENTION AND RELATED ART

The present invention relates to a charging device for charging a member to be charged such as an image bearing member mounted on a copying machine, laser beam printer or the like.

As a charging device for charging a surface of an electrophotographic type photosensitive member (image bearing member) in an image forming apparatus such as a copying machine, laser beam printer or the like, a known charging device produces less ozone during a charging operation (for example, Japanese Laid Open Patent Application No. SHO-63-149669, Japanese Laid Open Patent Application No. SHO-63-149669).

The charging roller as the charging member used in the contact charging device, comprises a center core metal, an electroconductive elastic layer thereon, and a urethane rubber layer in which carbon is dispersed, thereon. The opposite ends of the core metal are urged by urging members to press-contact the urethane rubber layer to the photosensitive member surface with a proper urging force. During a charging operation, the core metal is supplied with a superimposed voltage of a DC voltage of −700 V and an AC voltage having a frequency of 1000 Hz and a peak-to-peak voltage $V_{pp}$ of 1800 V, for example, by which the photosensitive member surface is charged uniformly to a potential of approx. −700 V through the urethane rubber layer. For the purpose of charging uniformity, the peak-to-peak voltage is set to be not less than twice as large as the charge starting voltage of the photosensitive member as the member to be charged, so that the resultant surface potential of the photosensitive member is substantially equal to the DC voltage applied to the charging member.

The charging device of a contact charging type using the charging roller described above, has the advantage that the production of ozone is small as compared with a corona charger which is a typical non-contact charging device. On the other hand, it has drawbacks that the surface of the photosensitive member is relatively easily damaged, that toner fusing tends to occur and that the photosensitive member is more quickly scraped, with the result of a short lifetime of the photosensitive member. The drawbacks result mainly from discharge by the AC voltage superimposed for the purpose of enhancing the charging uniformity of the photosensitive member surface.

In order to avoid the drawbacks, the photosensitive member can be charged by DC voltage alone (DC charging). In order to provide a target potential $V_0$ on the photosensitive member surface by the DC charging, a potential of a charge starting voltage $V_1$ of the photosensitive member plus a target potential $V_0$ ($V_0+V_1$) is applied to the charging member.

However, with DC voltage alone, the uniformity of the potential of the photosensitive member surface is not good with the result that image non-uniformity results due to the improper charging at various places.

Therefore, it is desirable that the DC charging is effected during the pre-rotation or during the charging for the non-image formation region (the region between adjacent transfer sheets) in which not very high uniformity is required, while the AC charging is carried out for the image formation region, by which the drawbacks are avoided. By Switching the voltage between DC charging and AC charging, the uniformity of the charging, and, simultaneously, the contamination or scraping of the photosensitive member can be minimized, so as to accomplish a long lifetime of the photosensitive member and low running cost.

When the switching is effected from the DC charging (only DC voltage is applied to the charging member) to the AC charging (the superimposed voltage of DC voltage and AC voltage is applied to the charging member), it is preferable that the DC voltage applied to the charging member is gradually lowered, and the peak-to-peak voltage of the AC voltage to be superimposed on the DC voltage is gradually increased, so that the potential difference on the photosensitive member before and after the switching is not too large. An example of the voltage switching is disclosed in Japanese Laid Open Patent Application No. SHO-63-208876.

However, with the voltage switching disclosed in Japanese Laid Open Patent Application No. SHO-63-208876 is effected, the following problems arise.

When the use is made with an organic photosensitive member having a charge starting voltage of 550 V, for example, the potential of the photosensitive member lowers too much during the process of gradual decrease of the DC voltage and gradual increase of the peak-to-peak voltage. If this occurs, potential non-uniformity results.

Referring to FIG. 6, (*a*) and (*b*), this will be described in detail.

FIG. 6, (*b*) shows a surface potential of the photosensitive member when the charging member is supplied with the bias waveform of FIG. 6, (*a*) shown in Japanese Laid Open Patent Application No. SHO-63-208876.

In FIG. 6, (*b*), the surface potential of the photosensitive member maintains −650 V during the period $t_1$ and decreases from −650 V to −250 V during the period $t_2$. In the period $t_2$, the AC component of the applied bias starts to rise, but the peak-to-peak voltage does not reach twice (550 V×2=1100 V) the discharge start voltage so that DC charging is substantially effected. Therefore, the surface potential of the photosensitive member decreases with decrease of the DC component. After the period $t_2$, the peak-to-peak voltage of the AC component is not less than 1100 V, and therefore, the AC charging is started in effect no that the surface potential of the photosensitive member becomes −800 V which is equal to the DC component applied.

Thus, when the bias waveform of FIG. 6, (*a*) is used, the surface potential of the photosensitive member temporally lowers to approx. −250 V, and this potential non-uniformity appears in the image.

SUMMARY OF THE INVENTION

Accordingly, it is a principal object of the present invention to provide a charging device wherein potential non-uniformity production is prevented upon switching between DC component mode and superimposing component mode.

It is another object of the present invention to provide a charging device wherein excessive lowering of the potential of the member to be charged is prevented upon switching between said superimposing component mode and the DC component mode.

It is a further object of the present invention to provide a charging device for charging uniformly the member to be charged.

These and other objects, features and advantages of the present invention will become more apparent upon a consideration of the following invention taken in conjunction with the accompanying drawings.

DESCRIPTION OF THE PREFERRED EMBODIMENT

Referring to the accompanying drawings, the embodiments of the present invention will be described.

Embodiment 1

Figure 1:
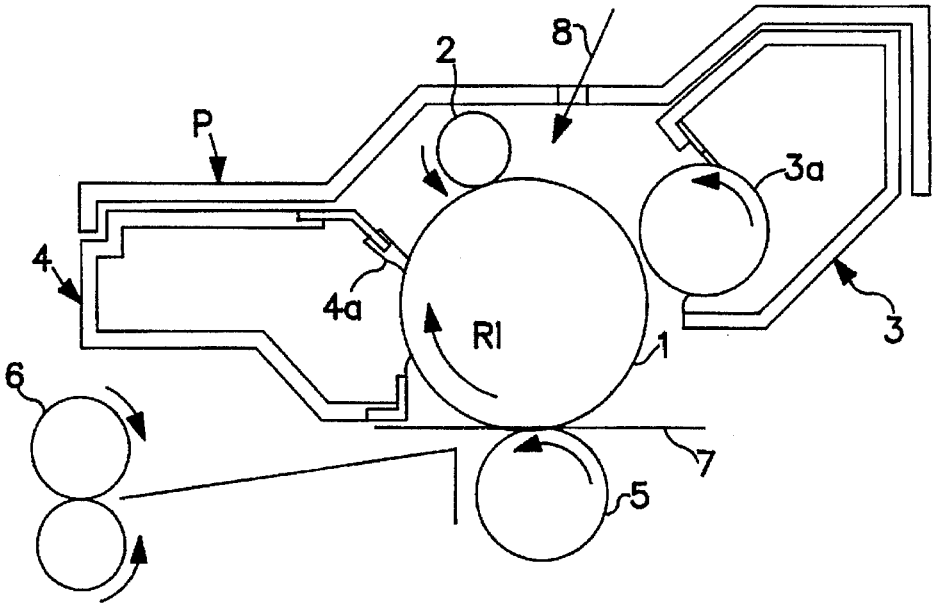
FIG. 1 is a schematic sectional view of an example of an image forming apparatus using a charging device of the present invention.

FIG. 1 is a schematic view showing schematically a construction of an image forming apparatus according to an embodiment of the present invention. The image forming apparatus of this embodiment is a laser beam printer, wherein a process cartridge P containing a photosensitive drum 1, a charging member 2, a developing device 3, a cleaning device 4 a so on as an unit, is detachably mountable to a main assembly of the device. The process cartridge P may contain the drum 1 and at least one of charging member 2, developing device 3 and cleaning device 4.

The photosensitive drum 1 comprises a drum-like aluminum base, an organic photosensitive member (OPC) or photoconductive member such as A—Si, CdS, Se, or the like applied thereon, and is rotated in arrow R1 direction by unshown driving means. In this embodiment, the photosensitive member is of OPC, and the photosensitive drum 1 surface is uniformly charged to a predetermined negative potential by a charging roller (charging member) constituting a part of a contact charging device which will be described hereinafter. It is then exposed to a laser beam 8 modulated in accordance with image information through exposure means (unshown), so that an electrostatic latent image is formed thereon. The electrostatic latent image is developed with negative charged toner by a developing roller 3*a* of a developing device 3 of electrostatic latent image into a toner image. The toner image on the photosensitive drum 1 is transferred onto a transfer material 7 fed from unshown feeding device by a transfer charger 5. The transfer material 7 after the transfer of the toner image is fed to the fixing device 6, and the toner image on the surface is heated and pressed and is fused and fixed. The transfer material 7 after the toner image fixing is discharged to the outside of the main assembly of the device. On the other hand, the photosensitive drum 1, after the toner image transfer, is cleaned by a cleaning blade 4a Of the cleaning device 4 so that the untransferred toner is removed to be prepared for the subsequent image formation.

Figure 2:
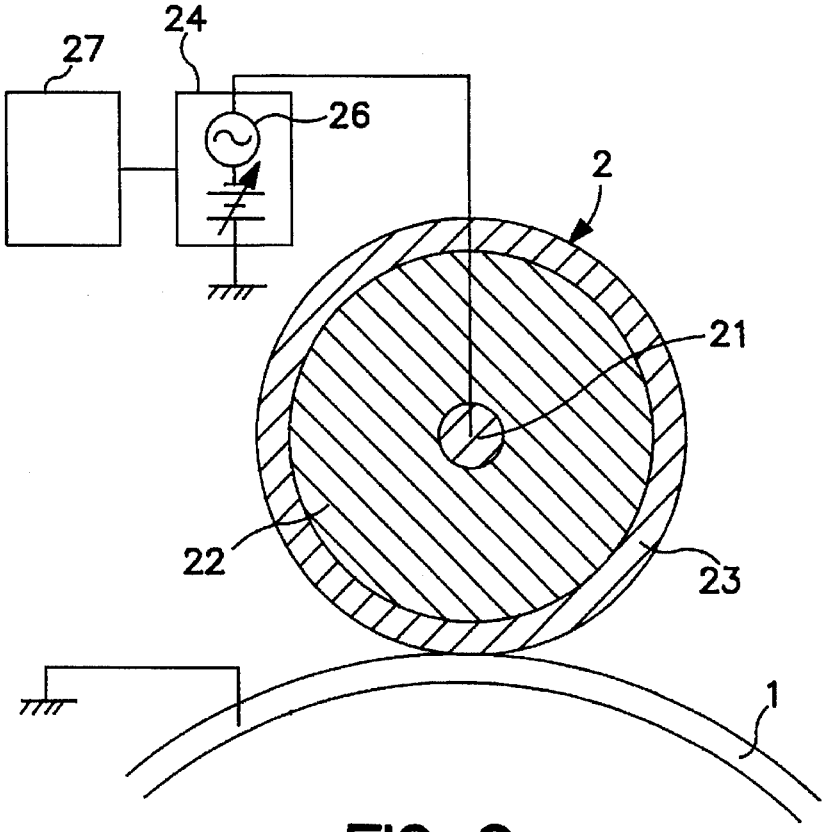
FIG. 2 is an enlarged view of the charging device.

FIG. 2 is an enlarged longitudinal section of the contact charging device. The contact charging device shown therein has a charging roller 2 as the charging member contacted to the photosensitive drum 1 surface. The charging roller 2 comprises a core metal 21 of metal positioned in parallel with a shaft of the photosensitive drum 1, an electroconductive elastic layer 22 on the core metal 21, a surface layer 23 on the surface of the elastic layer 22. The surface layer 23 has an adjusted resistance value provided by dispersing carbon in a urethane rubber layer.

A voltage source 24 is connected to the core metal 21. The voltage source 24 comprises a DC voltage source 25 and an alternating voltage source 26 so that it can supply to the core metal 21 a DC voltage or a superimposed voltage of a DC voltage and an AC voltage (alternating voltage). The voltage, application timing or the like are properly controlled by a control device 27.

FIGS. 7(A)–7(D) show a timing chart of the image forming apparatus.

First, an image formation start signal is supplied from outside of the printer, and the pre-rotation of the photosensitive drum starts, and immediately thereafter, the photosensitive member is charged by the charging roller 2 to start raising the surface potential of the photosensitive member. Normally, the photosensitive drum is rotated during the charging through not less than two full-turns (preferably 3 full-turns) in order to raise the surface potential of the photosensitive member to a predetermined value (target voltage −700 V). However, the AC charging is desired only immediately before the image formation requiring uniformity of the charging. In the charging before that, it suffices if the potential is increased to a certain degree, and the uniformity of the charging is not necessarily required. In view of this, in the charging during the pre-rotation of the drum, the potential of the photosensitive member is raised to a certain degree by the DC charging with less charging uniformity, and the AC charging is carried out for the last one full-turn to provide uniform charging.

During the image formation period, AC charging is carried out since the uniformity of the charging is desired. The image formation period is a period in which the region which is going to have an image is charged in the charging position. A part of the region of the photosensitive member having been subjected to the AC charging is exposed to a laser beam modulated in accordance with the image information by actuation of VIDEO signal.

In the sheet interval period after the image formation, the DC charging is continued to maintain the potential. The reason for this is that if the potential is lowered to 0V in the sheet interval, the potential of the photosensitive member has to be raised from 0 V, and therefore, larger amounts of drum rotation and charging is required. Here again, the AC charging is necessary only before one turn before the image formation, similarly to the pre-rotation, and therefore, the DC charging is carried out except therefor. The sheet interval period is a period in which such a region of the photosensitive member as is going to correspond to between a trailing edge of a transfer material and a leading edge of the subsequent transfer material is in the charging position.

During the post-rotation for sheet conveyance, the charging is continued. This because the next printing instructions may be supplied from outside, and in that case. It is desirable to raise the potential immediately. During this period, the uniformity of charging is not necessary, and therefore, the DC charging is carried out. Before ending the post-rotation of the drum, the drum is discharged using only the AC voltage during at least one full-turn of the drum to discharge it. The discharging is effected to lower all the charge potential, including triboelectric charge, of the drum substantially to 0 V.

As described in the foregoing, by using the DC charging to the maximum extent for the charging of the photosensitive member, the uniformity of the charging can be provided in the image formation portion, and simultaneously, the contamination and scraping of the photosensitive member can be minimized in the non-image portion. If only the AC charging is used as in a conventional example, the contamination or the scraping of the photosensitive member may be a problem.

In an image forming apparatus of reverse development type wherein the toner is deposited on the non-charged portion as in a laser printer, digital copying machine or the like, if the charging is not effected during the pro- and post-rotations, the non-image region is developed, and therefore, it is preferable to effect the charging always, irrespective of whether it is an image region or non-image region. Thus, the switching between the AC charging and DC charging is particularly effective in the image forming apparatus of the reverse development type.

Figure 3A:
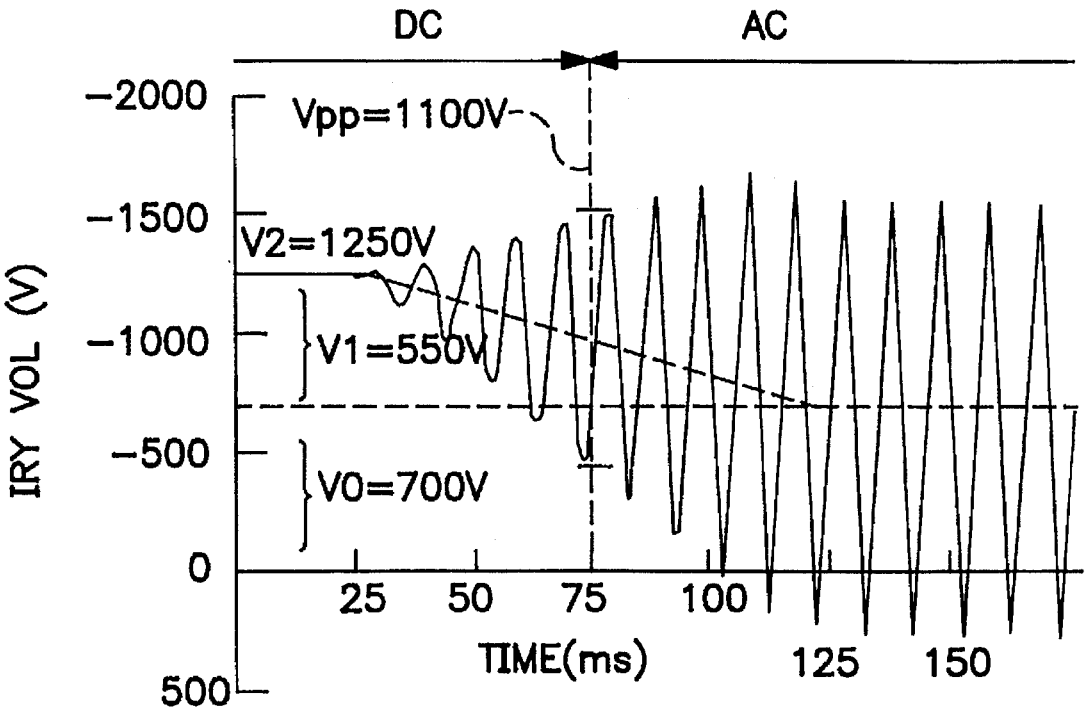
FIGS. 3(*a*) and 3(*b*) are graphs showing a voltage waveform and a surface potential upon switching from DC charging mode to AC charging mode in embodiment 1.
Figure 3B:
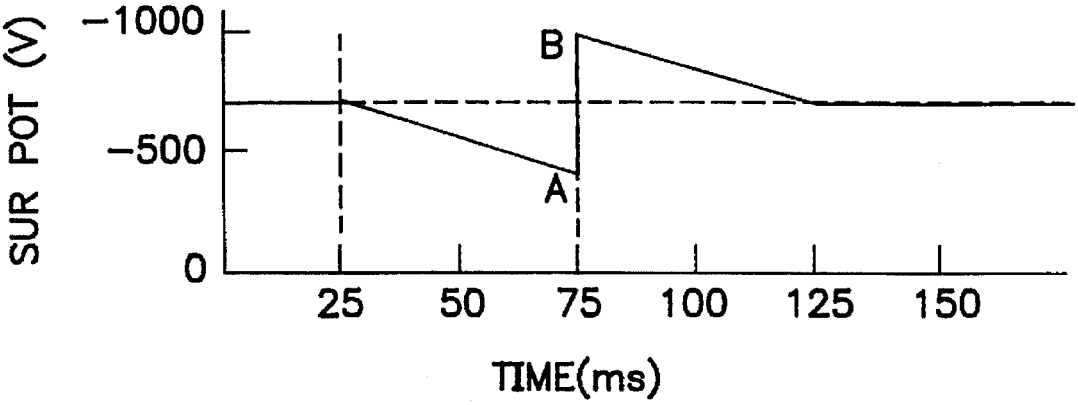

Referring to FIGS. 3(*a*) and 3(*b*) there is shown an example, wherein the voltage applied to the charging roller 2 is suppressed by a control device 27, so that the surface potential of the photosensitive drum upon switching from the DC charging to the AC charging is prevented from lowering too much. Here, with the DC charging means, only the DC voltage is applied to the charging member or a superimposed voltage of a DC voltage and a AC voltage is applied in which the peak-to-peak voltage of the voltage is smaller than twice the charge starting voltage of the photosensitive member. The AC charging means operates such that a superimposed voltage of a DC voltage and an AC voltage is applied wherein the peak-to-peak voltage of the voltage is not less than twice the charge starting voltage of the photosensitive member.

The charge starting voltage is a voltage at which the charging of the member to be charged starts when a DC voltage alone is applied to the charging member contacted to the member to be charged and the voltage is increased.

In this embodiment, the photosensitive member as the member to be charged has an organic photoconductive layer of a negative charging property, and the charge starting voltage of the photosensitive member is 550 V.

Figure 6A:
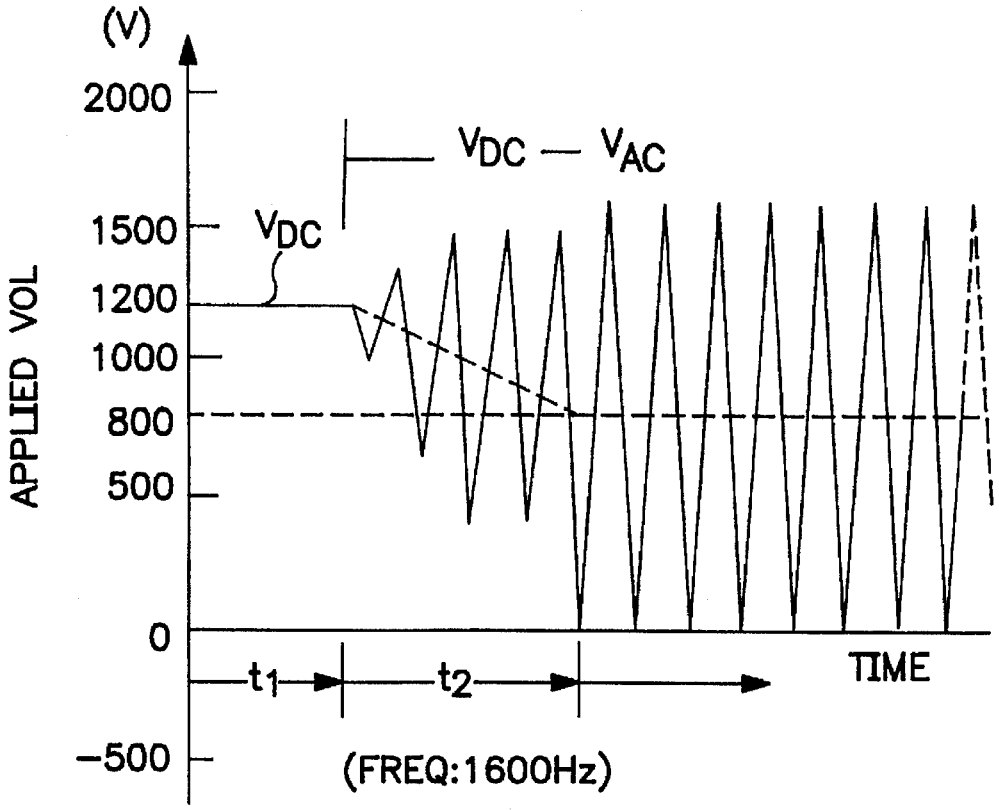
FIGS. 6(*a*) and 6(*b*) are graphs showing a voltage waveform and surface potential in a conventional example.
Figure 6B:
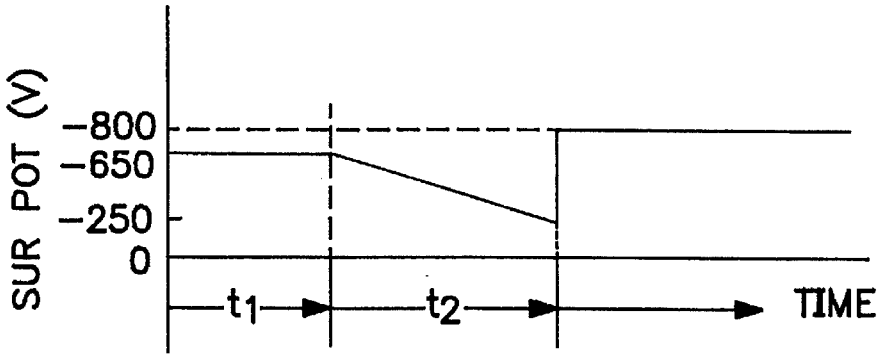
Figure 7:
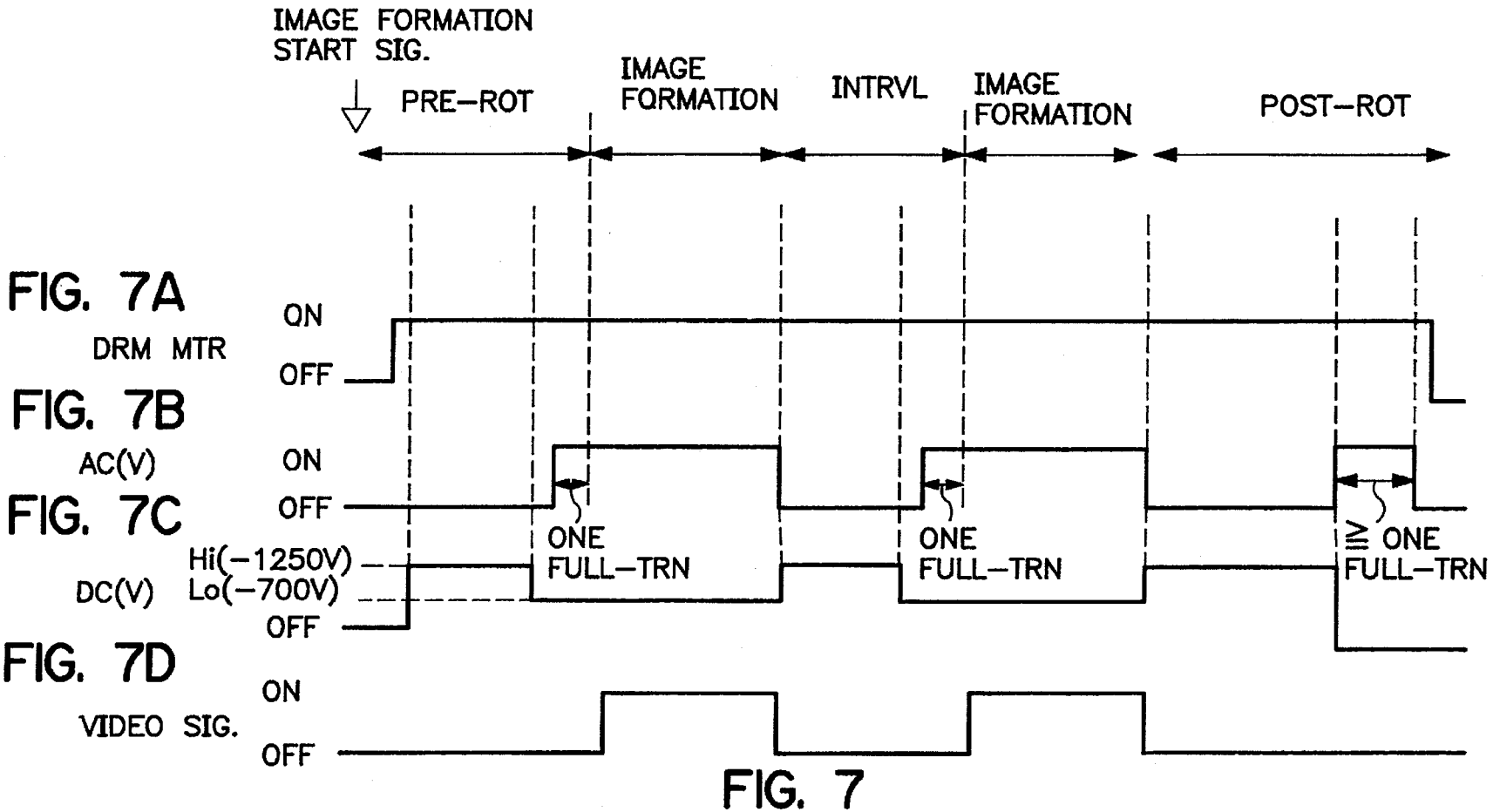
FIGS. 7(A)–7(O) illustrate is a timing chart used in embodiment 1.

The DC component of the applied voltage in FIGS. 3(*a*) and 3(*b*) is the bias of the DC charging during 0–25 ms, and is a constant voltage of V2=−1250 V. The falling of the DC component starts at 25 ms, and it changes from V2=−1250 V to V0 (target voltage)=−700 V in 100 ms (to 125 ms in the same Figure). After 125 ms, a constant voltage of target potential V0(=−700 V) for AC charging is maintained. On the other hand, the AC component (oscillation component) of the applied voltage starts to rise at 25 ms in the Figure, and continues to increase for 85 ms (to 110 ms in the Figure) to 1800 V of the peak-to-peak voltage. Thereafter (after 110 ms in the Figure), the peak-to-peak voltage of 1800 V is kept. The increase rate during the rising period of the AC component is larger than in the conventional bias waveform (FIGS. 6(*a*) and 6(*b*)). Therefore, the peak-to-peak voltage of the AC component reaches 1100 V (twice the charge starting voltage 550 V) where the AC charging starts, 50 ms after the start of the rising thereof. At this point of time, the DC component is on the way of decrease.

The surface potential of the photosensitive drum when the photosensitive drum is charged using the above bias waveform, is as shown in FIG. 3, (*b*). The minimum value of the surface potential in this Figure is −425 V, and the decrease of the surface potential is smaller than the conventional example.

In this embodiment, the AC charging is started during the decrease of the DC component (75 ms in FIG. 3, (*a*)). Using this waveform, the surface potential of the photosensitive drum is such that the center value between the minimum value (FIG. 3, (*b*), potential A) and the maximum value (FIG. 3, (*b*), potential B) is substantially equal to the target potential −700 V of the photosensitive member. The applicants have found that the image non-uniformity due to the potential non-uniformity is minimized under the above condition. In the foregoing, the description has been made as to the case in which the DC component of the bias is decreased and peak-to-peak voltage of the AC component is increased upon switching from the DC charging to the AC charging, and the peak-to-peak voltage of the AC component is increased to not less than twice the charge starting voltage of the member to be charged during the decreasing period of the DC component, by determining the increase rate of the AC component, so that the decrease of the surface potential is reduced.

Similarly, upon the switching from the AC charging to DC charging, the DC component of the bias is increased, and the peak-to-peak voltage of the AC component is decreased, and in addition, the peak-to-peak voltage of the AC component is decreased to not more than twice the charge starting voltage of the member to be charged within the increase period inside of the DC component, so that the decrease of the surface potential can be reduced.

Embodiment 2

A second embodiment for the switching between the DC charging and the AC charging will be described. In this embodiment, the construction and operation of the device are the same as embodiment 1, and therefore, the description thereof is omitted.

Figure 4A:
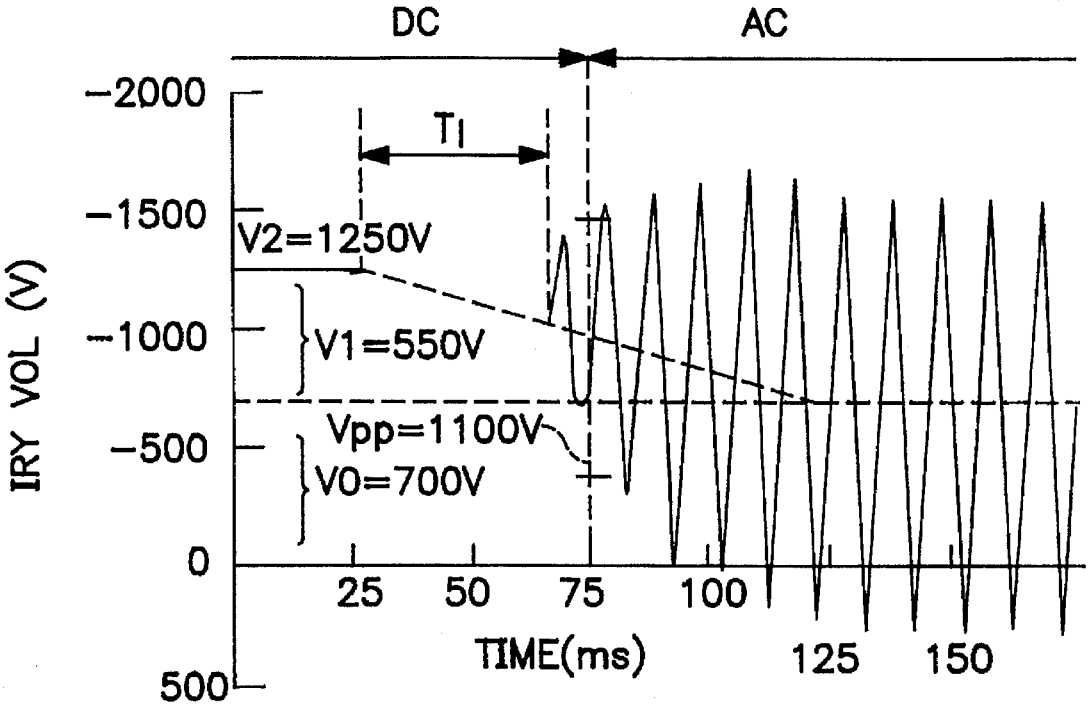
FIGS. 4(*a*) and 4(*b*) are graphs showing a voltage waveform and a surface potential upon switching from DC charging to AC charging in embodiment 2.
Figure 4B:
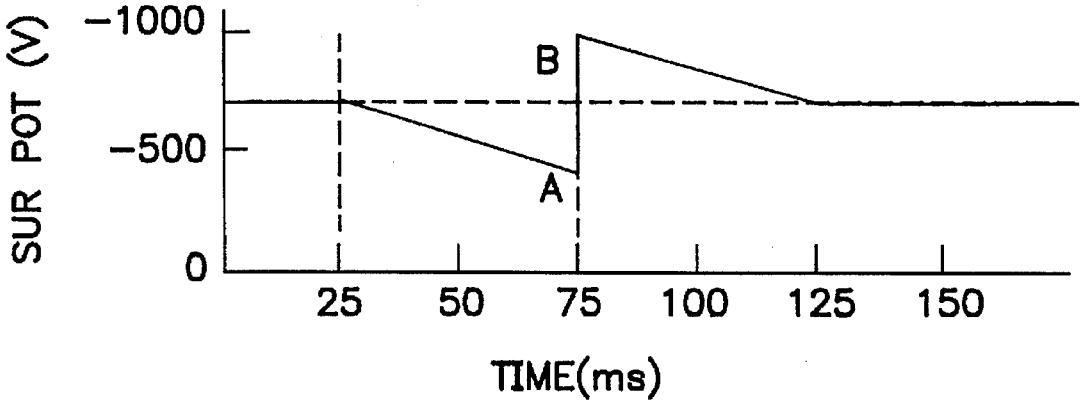

FIGS. 4(*a*) and 4(*b*) shows an applied bias waveform supplied to the charging roller upon the switching from the DC charging to the AC charging in this embodiment. In this embodiment, the AC component rising is started after a delay time after the start of the falling of the DC voltage. By the provision of the delay period in accordance with the increase rate of the AC component, the time of switching from the DC charging to the AC charging can be adjusted so that the surface potential non-uniformity of the photosensitive drum can be minimized.

In the Figure, the DC component of the applied voltage is that of the bias for the DC charging during 0–25 ms, and is a constant voltage of V2=−1250 V. The falling of the DC component starts at 25 ms, and it changes from V2=−1250 V to V0(target voltage) =−700 V in 100 ms (to 125 ms, in the Figure). After 125 ms, the constant voltage of target potential V0(=−700 V) for the AC charging is maintained. On the other hand, the AC component (oscillation component) is started with delay time T1(=40 ms) from the start of the lowering of the DC component (65 ms in the Figure). Thereafter, it continues to increase during 25 ms (95 ms in the Figure) so that the peak-to-peak voltage reaches 1800 V. Thereafter (after 95 ms in the Figure), the peak-to-peak voltage 1800 V is maintained. The peak-to-peak voltage of the AC component reaches voltage 1100 V (twice the charge starting voltage 550 V) for the AC charging start 10 ms after (75 ms) from the start of the rising of the peak-to-peak voltage, and then the AC charging starts. At this point of time the DC component is on the charge starting voltage of decrease.

The surface potential of the photosensitive drum when the photosensitive drum is charged using the bias waveform, is shown in FIG. 4, (*b*). In Figure 4, the minimum value of the surface potential is −425 V, and the decrease of the surface potential is smaller than in the conventional example.

In this embodiment, the AC charging is started during the decrease of the DC component (75 ms in FIG. 4, (*a*)). Using this waveform, the center value between the minimum value (A in FIG. 4, (*b*)) and the maximum value (B in FIG. 4, (*b*)) is substantially equal to the target potential of −700 V. The applicant has found that the image non-uniformity due to the potential non-uniformity is minimized under the above condition.

Figure 5:
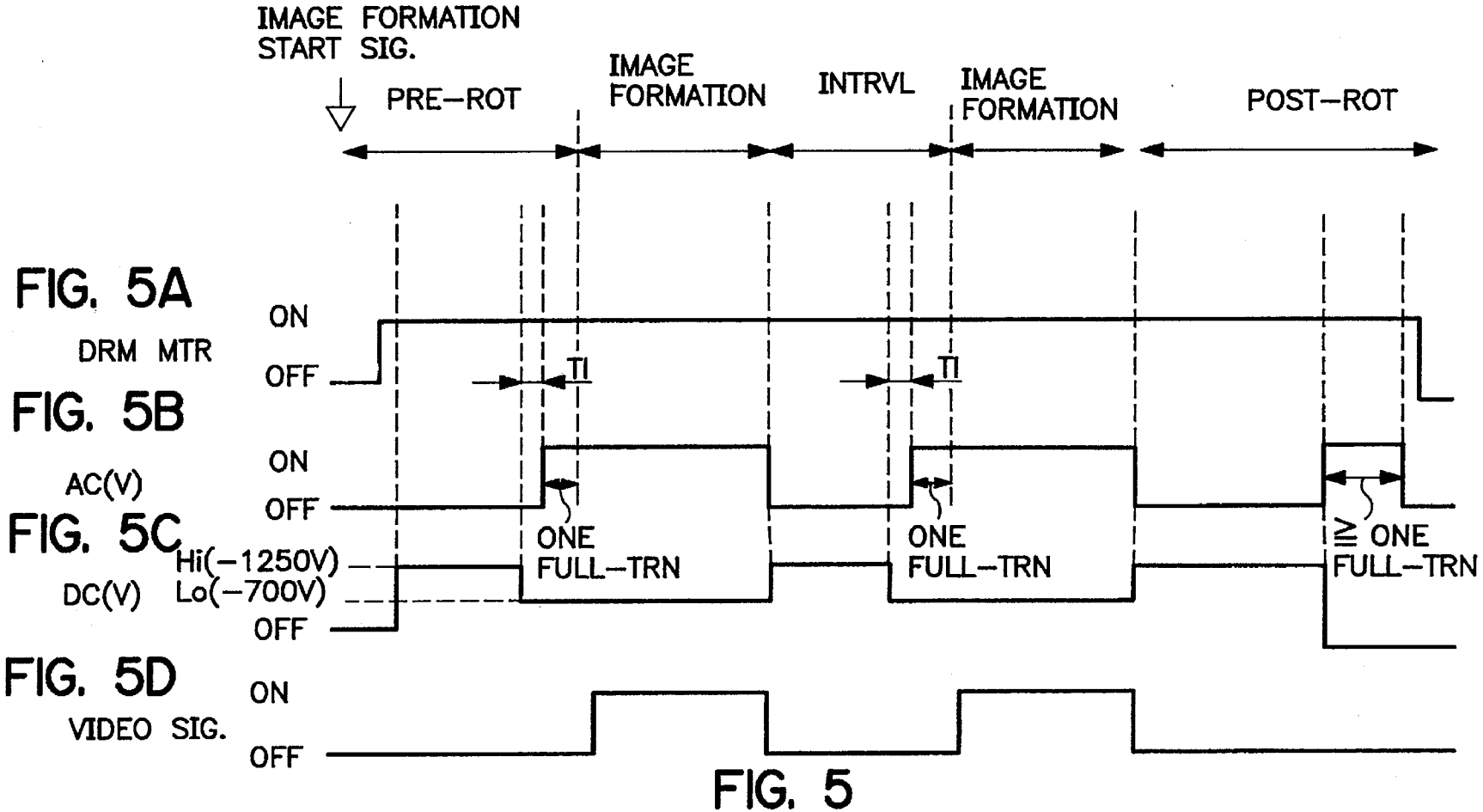
FIGS. 5(A)–5(D) illustrate a timing chart used in embodiment 2.

FIGS. 5(A)–5(B) a timing chart for image formation when this embodiment is used.

The description of this embodiment has been made as to the case in which the delay time T in accordance with the increase rate of the AC component is provided after the start of the falling of the DC voltage upon the switching from the DC charging to the AC charging, and after the delay time, the rising of the AC component is started, and during the decreasing period of the DC component, the peak-to-peak voltage of the AC component is increased to twice the charge starting voltage of the member to be charged, so that the decrease of the surface potential is reduced.

Upon the switching from the AC charging to the DC charging, a delay time T is provided from the increase start of the DC component of the bias, and after the delay, the peak-to-peak voltage of the AC component is decreased, and the peak-to-peak voltage of the AC component is decreased to less than twice the charge starting voltage, of the member to be charged during the increase period of the DC component, so that the decrease of the surface potential can be reduced.

In embodiments 1 and 2, upon the switching from the DC charging to the AC charging or upon the switching in the opposite direction, the voltage applied to the charging member can be prevented from exceeding the leakage limit voltage (withstand voltage of the photosensitive member), so that the damage of the photosensitive member or charging member can be prevented, and simultaneously the runaway of the electronic circuit of the main assembly of the device can be prevented.

As described in the foregoing, the increase rate of the AC component upon the switching from the DC charging to the AC charging is adjusted, or the rising of the AC component 1s started after the delay time T in accordance with the increase rate of the AC component after the decrease start of the DC component, so that the peak-to-peak voltage of the AC component increases to not less than twice the charge starting voltage of the member to be charged during the decreasing period of the DC component, so that the surface potential non-uniformity can be reduced.

In FIG. 3, (*a*), FIG. 4, (*a*), the AC voltage is in the form of a sunisoidal wave, but it may be a triangle wave, rectangular wave or the like. In place of the sunisoidal wave of FIG. 3, (*a*), FIG. 4, (*a*), a rectangular wave is usable, and in such a case, only a DC voltage source may be used. More particularly, the voltage waveform of superimposed AC voltage and DC voltage may be produced only by a DC voltage source.

While the invention has been described with reference to the structures disclosed herein, it is not confined to the details set forth and this application is intended to cover such modifications or changes as may come within the purposes of the improvements or the scope of the following claims.

What is claimed is:

1. A charging device comprising:

a member to be charged; and a charging member for charging said member to be charged, said charging member being contactable to said member to be charged and being supplied with a voltage, wherein upon switching of the voltage from a DC component mode to a superimposing component mode of a DC component and an oscillation component, said DC component is decreased and a peak-to-peak voltage of said oscillation component is increased in a period, wherein said peak-to-peak voltage is changed from a first voltage which is smaller than twice a charge starting voltage of said member to be charged to a second voltage which is at least twice the charge starting voltage, while the peak-to-peak voltage is increasing, and wherein the increase of said peak-to-peak voltage is started after a predetermined time elapses from starting the decrease of said DC component.

2. A device according to claim 1, wherein said charging member is in the form of a roller configuration.

3. A device according to claim 1, wherein said member to be charged is an image bearing member for bearing an image, and said voltage is applied in the superimposing component mode for a first region which is going to an image region, and is applied in said DC component mode for a second region prior to said first region.

4. A device according to claim 1, wherein during decreasing of said DC component, said peak-to-peak voltage is changed from said first voltage to said second voltage.

5. A device according to claim 4, wherein during decreasing of said DC component, increasing of said peak-to-peak voltage is terminated.

6. A charging device comprising:

a member to be charged; and a charging member, contactable to said member to be charged, for charging said member to be charged, said member to be charged being supplied with a voltage, wherein upon switching of the voltage from a superimposing component mode of a DC component and an oscillation component to a DC component mode, a peak-to-peak voltage of said oscillation component is decreased, and said DC component is increased in a period, and wherein said peak-to-peak voltage is changed from a first voltage which is not less than twice the charge starting voltage of the member to be charged to a second voltage which is less than twice the charge starting voltage, while the peak-to-peak voltage is decreasing.

7. A device according to claim 6, wherein the decrease of said peak-to-peak voltage is started after a predetermined time elapses after starting the increase of said DC component.

8. A device according to claim 6, wherein said charging member is in the form of a roller configuration.

9. A device according to claim 6, wherein said member to be charged is an image bearing member for bearing an image, and said voltage is applied in the superimposing component mode for a first region which is going to an image region, and is applied in said DC component mode for a second region prior to said first region.

10. A charging device comprising:

a member to be charged; and a charging member for charging said member to be charged, said charging member being contactable to said member to be charged and being supplied with a voltage, wherein upon switching of said voltage from a DC component mode to a superimposing component mode of a DC component and an oscillation component, said DC component is decreased, and a peak-to-peak voltage of said oscillation component is increased in a period, and wherein the increase of the oscillation component is started after a predetermined time period elapses from starting the decrease of said DC component.

11. A device according to claim 10, wherein said charging member is in the form of a roller configuration.

12. A device according to claim 10, wherein said member to be charged is an image bearing member for bearing an image, and said voltage is applied in the superimposing component mode for a first region which is going to an image region, and is applied in said DC component mode for a second region prior to said first region.

13. A device according to claim 10, wherein during decreasing of said DC component, increasing of said peak-to-peak voltage is terminated.

* * * * *

UNITED STATES PATENT AND TRADEMARK OFFICE

CERTIFICATE OF CORRECTION

PATENT NO. : 5,649,268

DATED : July 15, 1997

INVENTORS : Youichirou Maebashi, et al.

It is certified that error appears in the above-identified patent and that said Letters Patent is hereby corrected as shown below:

COVER PAGE

Under [56] References Cited, insert --U.S. PATENT DOCUMENTS
5,144,368 9/1992 Ohzeki et al. 355/219--.

Under [56] References Cited, Foreign Patent Documents,
insert --367203 5/1990 European Pat. Off.
6-222676 8/1994 Japan--.

COLUMN 1

Line 19, "63-149669" should read --63-149668--.

COLUMN 2

Line 2, "Switching" should read --switching--; and
Line 44, "no" should read --so--.

COLUMN 3

Line 20, "7(A)-7(O)" should read --7(A)-7(D)--;
Line 34, "an" should read --a--; and
Line 60, "Of" should read --of--.
Line 34, "a" should read --and--.

COLUMN 4

Line 57, "This because" should read --This is because--; and
Line 60, "case. It" should read --case, it--.

UNITED STATES PATENT AND TRADEMARK OFFICE

CERTIFICATE OF CORRECTION

PATENT NO. : 5,649,268

DATED : July 15, 1997

INVENTORS : Youichirou Maebashi, et al.

It is certified that error appears in the above-identified patent and that said Letters Patent is hereby corrected as shown below:

COLUMN 5

Line 13, "pro-" should read -- pre- --.

COLUMN 7

Line 9, "5(A)-5(B)" should read --5(A)-5(D) illustrate--;
Line 25, "voltage," should read --voltage--; and
Line 40, "1s" should read --is--.

Signed and Sealed this

Tenth Day of February, 1998

*Attest:*

*Attesting Officer*

BRUCE LEHMAN

*Commissioner of Patents and Trademarks*